United States Patent [19]

Wang

[11] Patent Number: 4,994,636

[45] Date of Patent: Feb. 19, 1991

[54] ELECTRICAL CONTROL DEVICE

[75] Inventor: Jui-S. Wang, Taipei, Taiwan

[73] Assignee: Duracraft Corporation, Sudbury, Mass.

[21] Appl. No.: 447,344

[22] Filed: Dec. 7, 1989

[51] Int. Cl.[5] ..... H01H 15/02; H01H 9/28

[52] U.S. Cl. ..... 200/548.000; 200/43.16; 200/321

[58] Field of Search ..... 200/548, 43.17, 43.18, 200/43.21, 321, 43.16, 43.19

[56] References Cited

U.S. PATENT DOCUMENTS

| | | | |
|---|---|---|---|
| Re. 30,273 | 5/1980 | Grebner et al. | 200/321 |
| 2,138,387 | 11/1938 | Officer et al. | 200/548 |
| 4,280,026 | 7/1981 | Alessio | 200/321 |
| 4,480,159 | 10/1984 | Kirchoff | 200/321 |
| 4,506,119 | 3/1985 | Tanabe | 200/548 |

*Primary Examiner*—Henry J. Recla
*Assistant Examiner*—Robert C. Lawson
*Attorney, Agent, or Firm*—John E. Toupal; Harold G. Jarcho

[57] ABSTRACT

A control including an activator for effecting a control function; an actuator coupled to the activator and movable in a reciprocating path to control operation thereof; an operator coupled to the actuator and adapted for manual manipulation between active and inactive positions, the operator in its active position rendering the actuator functional to control operation of the activator and in its inactive position rendering the actuator dysfunctional to control operation of the activator; and a means biasing the operator in its inactive position.

5 Claims, 1 Drawing Sheet

ELECTRICAL CONTROL DEVICE

BACKGROUND OF THE INVENTION

This invention relates generally to a control and, more specifically to an electrical control device that can be latched in a dysfunctional condition.

Various control devices have each been provided with a rotatable selector shaft for turning on and off the control device or for selectively determining the operating condition of the control device or the like. Typically, such devices include means for locking a selector shaft of such a control device in its "off" position and thereby requiring unlocking of such selector shaft before the same can be turned to an "on" position thereof whereby a safety feature is provided. The object of this invention is to provide an improved, more easily operated control device of that type.

SUMMARY OF THE INVENTION

The invention is a control including an activator for effecting a control function; an actuator coupled to the activator and movable in a reciprocating path to control operation thereof; an operator coupled to the actuator and adapted for manual manipulation between active and inactive positions, the operator in its active position rendering the actuator functional to control operation of the activator and in its inactive position rendering the actuator dysfunctional to control operation of the activator; and a means biasing the operator in its inactive position. The reciprocating operator provides both safe and efficient control of the activator.

According to certain features of the invention, the actuator is mounted for sliding movement on a housing wall and the operator includes a latch portion that in its inactive position latches the actuator to the housing so as to prevent sliding movement thereof. This arrangement permits latching of the operator to discourage unauthorized control of the activator.

According to other features of the invention, the housing wall defines an opening, and the actuator includes a handle portion disposed on one side of the wall and a coupling portion extending through the opening and connected to the activator. Mounting of the actuator and activator are simplified by this structural configuration.

According to yet other features of the invention, the latch portion is disposed on a side of the wall portion opposite to the one side, and the operator further comprises an outer portion accessible on the one side. This arrangement facilitates mounting and accessibility of the operator.

According to further features of the invention, the handle portion defines an aperture receiving the outer portion, the operator further comprises a stem portion connecting the latch and outer portions and extending through the opening, and the means for biasing comprises a spring seated between the activator and the operator and urging the latch portion into engagement with the opposite side of the wall portion. The desired latching functions are simplified by this compact structural configuration.

In a preferred embodiment of the invention, the activator is an electrical switch. The control is particularly well suited for use in controlling operation of an electrical switch.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
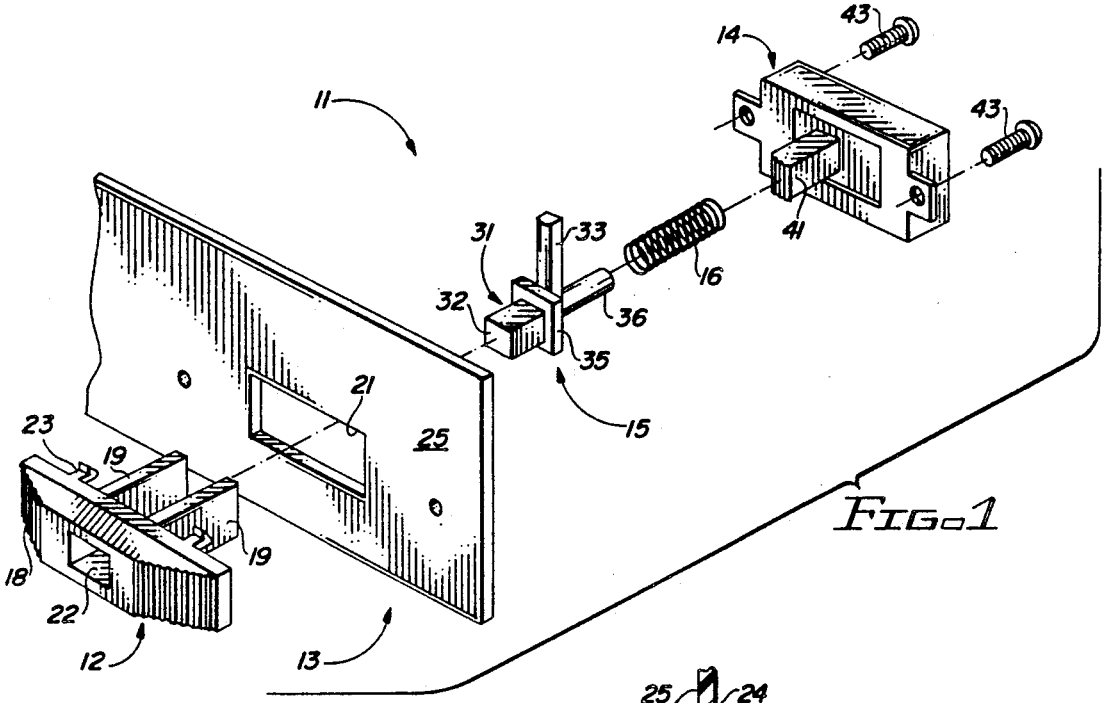
FIG. 1 is an exploded perspective view of a control device according to the invention.

A control device 11 according to the invention is illustrated in FIGS. 1–4. An actuator slide 12 is retained by a wall portion 13 of a housing and is operatively coupled to an electrical activator slide switch 14. Associated with the actuator slide 12 is an operator member 15 that is biased into an inactive position by a spring 16.

The actuator slide 12 includes a handle portion 18 and a coupling portion formed by a pair of spaced apart legs 19 that extend through an opening 21 in the wall 13. Formed in the handle portion 18 and communicating with a space between the legs 19 is a rectangular aperture 22. During insertion of the legs 19 through the opening 21, flexible tabs 23 on the handle portion 18 are deflected inwardly by the wall 13 and then engage an inner surface 24 thereof to retain the actuator 12 in slidable engagement with the front surface 25 of the wall portion 13.

The operator member 15 includes a stem portion 31 having an outer knob portion 32 of rectangular cross-section and a laterally extending latch arm portion 33. The knob portion 32 is received by the aperture 22 in the handle portion 18. Located between the latch arm 33 and the stem portion 31 and extending transversely therefrom is a shoulder portion 35. The shoulder portion 35 guides movement of the operator member 15 between the legs 19 and engages a rear surface portion 38 of the handle portion 18. A guide pin portion 36 of the operator member 15 extends from the stem portion 35 and is axially aligned therewith.

The activator switch 14 is conventional and includes an operating shaft 41. In response to sliding reciprocal movement of the shaft 41, the switch 14 can control operation of electrical equipment (not shown) connected therewith. Received by the guide pin 36 is the spring 16 which is seated between the shaft 41 of the switch 14 and the latch arm portion 33 of the operator member 15. The switch 14 is secured to the rear surface 24 of the wall 13 by screws 43.

Figure 2:
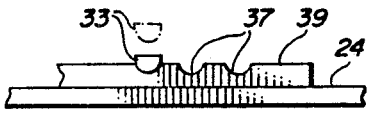
FIG. 2 is a detailed view of a latching portion of the device shown in FIG. 1.
Figure 3:
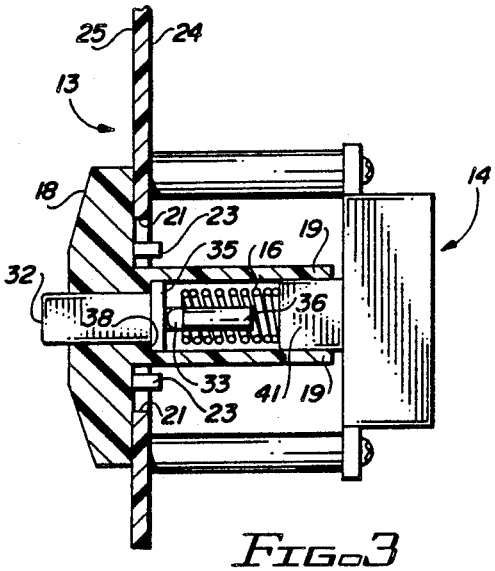
FIG. 3 is a horizontal cross-sectional view of the device shown in FIG. 1.
Figure 4:
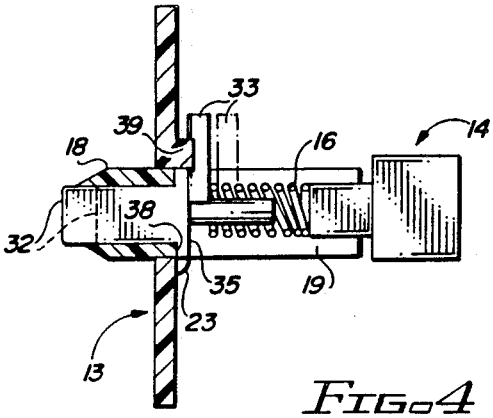
FIG. 4 is vertical cross-sectional view of the device shown in FIG. 1.

As shown in FIG. 2, the latch arm 33 is arranged for reception by any of a plurality of slots 37 in a rod 39 secured to the rear surface 24 of the wall portion 13. The spring 42, as shown in FIGS. 3 and 4, normally biases the operator member 15 into an inactive position in which the latch arm 33 is retained within one of the slots 37. Because of this engagement between the operator member 15 and the rod portion 39 of the wall 13, sliding movement of the handle portion 18 along the front surface 25 is normally prevented. Thus, the actuator slide 12 normally is rendered dysfunctional to control operation of the activator switch 14.

When operation of the switch 14 is desired, the operator member 15 is moved into an active position as shown by dashed lines in FIGS. 2 and 4. The active position of the operator member 15 is attained by pushing the knob portion 32 to induce inward movement of the member 15 against the biasing force of the spring 42. In response to inward movement of the member 15, the latch arm 33 is withdrawn from any of the slots 37 to thereby unlatch the operator member 15 from the housing 13. Accordingly, the activator slide 12 can be moved selectively in a reciprocating linear path along the wall 13 and thereby move the shaft 41 of the switch 14 into a desired control position. Thus, the operator member 14 can be used to render the actuator slide 12 functional to control operation of the switch 14. Upon attainment of a desired switch position and release of applied pressure to the knob portion 32, the spring 16 returns the latch arm 33 into engagement within an aligned slot 37. This latching of the operator member 15 to the housing wall 13 again renders the actuator slide 12 dysfunctional to control operation of the switch 14.

Obviously, many modifications and variations of the present invention are possible in light of the above teachings. It is to be understood, therefore, that the invention can be practiced otherwise than as specifically described.

What is claimed is:

1. A control comprising:

housing means;

activator means for effecting a control function;

actuator means coupled to said activator means and movable in a reciprocating rectalinear path on said housing means to control operation of said activator means;

operator means coupled to said actuator means and adapted for manual manipulation between active and inactive positions; said operator means in said active position rendering said actuator means functional to control operation of said activator means and in said inactive position rendering said actuator means dysfunctional to control operation of said activator means, and wherein said operator means comprises a latch portion that engages said housing means in said inactive position to prevent movement of said operator means; and a spring seated between said activator means and said operator means and urging said latch portion into engagement with said housing means so as to bias said operator means in said inactive position.

2. A control according to claim 1 wherein said housing means comprises a wall portion defining an opening, said actuator means comprises a handle portion disposed on one side of said wall portion and a coupling portion extending through said opening and connected to said activator means.

3. A control according to claim 2 wherein said latch portion is disposed on a side of said wall portion opposite to said one side.

4. A control according to claim 3 wherein said operator means further comprises an outer portion accessible on said one side.

5. A control according to claim 4 wherein said handle portion defines an aperture receiving said outer portion, and said operator further comprises a stem portion connecting said latch and outer portions and extending through said opening.

* * * * *